United States Patent [19]

Gordon

[11] Patent Number: 4,754,590

[45] Date of Patent: Jul. 5, 1988

[54] METHOD AND APPARATUS FOR WATERPROOFING CONCRETE

[76] Inventor: James R. Gordon, 530 Lolita Gardens, #805, Mississauga, Ontario, Canada

[21] Appl. No.: 907,328

[22] Filed: Sep. 15, 1986

[51] Int. Cl.[4] ..... E04G 23/02

[52] U.S. Cl. ..... 52/741; 52/309.3; 52/309.4; 52/514

[58] Field of Search ..... 249/38, 40, 42, 213, 249/214, 215, 216; 52/514, 743, 309.4, 309.3, 741; 217/182, 98, 110; 152/370

[56] References Cited

U.S. PATENT DOCUMENTS

| | | | |
|---|---|---|---|
| 2,762,413 | 9/1956 | Walter | 152/370 |
| 3,216,171 | 11/1965 | Jenkins | 52/309.4 |
| 3,390,498 | 7/1968 | Roy et al. . | |
| 3,430,914 | 3/1969 | Clasen | 249/214 |
| 3,889,436 | 6/1975 | Elliot . | |
| 3,918,673 | 11/1975 | Abbott | 249/43 |
| 4,016,696 | 4/1977 | Mess et al. . | |
| 4,302,917 | 12/1981 | Fermvik | 52/309.4 |
| 4,356,676 | 11/1985 | Hauptman | 52/403 |
| 4,395,162 | 7/1983 | Murphy | 405/260 |
| 4,470,504 | 9/1984 | Paban | 405/261 |
| 4,653,246 | 3/1987 | Hepler | 52/309.2 |

*Primary Examiner*—John E. Murtagh

*Attorney, Agent, or Firm*—Donald E. Hewson

[57] ABSTRACT

A rod hole plugging system for providing an effective permanent plug within a tie rod hole extending through the thickness of a poured cement wall utilizes a short, low cost plug selected from natural fibre or synthetic foam, which is soaked by a liquid resin coating which is seasonally selectible to meet environmental conditions. The selected plug has a diameter exceeding that of the rod hole to be plugged. The selected group of resins is water-tolerating and impermeable, and may be a high solids polyisocyanate prepolymer that will harden to a polyurethane polymer; or it may be a selected mixture of epoxy resin and hardener. The plug is soaked in the resin, and is then diametrically compressed and inserted within the interior (i.e., inside the foundation of the structure) end of the rod hole being treated. The elastic memory of the plug material causes it to swell and engage the walls of the rod hole, in which condition the liquid resin sets up. A low cost, substantially waterproof, permanent plug for the rod hole is thereby established.

4 Claims, 1 Drawing Sheet

METHOD AND APPARATUS FOR WATERPROOFING CONCRETE

BACKGROUND OF THE INVENTION

This invention is directed to a system for plugging holes, and in particular to sealing with an impermeable plug the rod holes extending through from face to face of poured concrete walls, using a range of materials so as to encompass continental climatic extremes and variations.

PRIOR ART SYSTEMS AND ENVIRONMENTAL REQUIREMENTS

In the residential construction field in the United States and Canada, widespread use is made of poured concrete for foundations, more particularly for below grade basement walls of houses and other residential buildings.

Shuttering or other forms are erected, within which the concrete is to be poured, the shuttering being secured in spaced relation by steel tension rods, secured by wedging at the outside of the shuttering. When the concrete is placed, and sets up, the rods and shuttering are removed, leaving a concrete wall having a large number of side to side rod hole penetrations extending therethrough. The rod holes are plugged, usually externally, at the outside wall surface, and the wall may be parged to waterproof it, and the excavation is then back filled with soil.

In these conditions water can accumulate, and in the absence of effective rod hole seals, significant water seepage, and even flooding can ensue. It is even know to experience the occurrence of hydrostatic pressure build-up sufficient to drive a sealing cork through the rod hole, leaving the unprotected hole as a drain passage into the basement, with consequent flooding. Rectification of this type of occurrence, particularly subsequent to backfilling, is extremely costly.

Prior art solutions are set forth in U.S. Pat. Nos. 3,390,498, Roy et al, issued July 2, 1968; 3,889,436 Elliot, issued June 17, 1975; 4,016,696, Mess et al, issued Apr. 12, 1977.

Roy et al provides an oversize wedge shaped plug of polyethylene, having serrated surfaces, which is driven into the two ends of the rod hole at the time of striking the formwork.

Elliot shows the use of a precast portland cement plug, cemented into the rod holes.

Mess et al teaches a system having an elastomeric plug containing a closed bore into which a placement tool is inserted to elongate and diametrically contract the plug as it is driven into place in the rod hole. Upon withdrawal of the placement tool, the plug contacts axially and expands diametrically to grip the walls of the rod hole.

It is noteworthy that these patents are all well established in time, and yet the problem persists. It can only be inferred that, for whatever reason, these prior art systems are ineffective.

In accordance with the present invention there is provided a climatically compatible, low cost, rod hole sealing system incorporating a compressible oversize plug selected from natural fibre or synthetic foam material in combination with a suitable curing liquid resin material. The liquid resin is usually an epoxy material having a resin selected from a number of suitable resins, and reacted with an amine hardener; but it may also be a high solids polyisocyanate prepolymer, suitably modified with surfactants and catalysts so as to harden to a polyurethane polymer in the presence of moisture. Any of the liquid resins used should harden or set up in a period of a few minutes to several hours—usually 30 minutes to 4 hours.

The compressible oversize plug is selected from a natural fibre such as jute or hemp, or from synthetic foam material in the form of a rod or rope of open cell or closed cell polyurethane, polyethylene or polystyrene. As to the resin, the functional requirements of the material are: it must be able to set up and remain effective in the presence of water, and it must be compatible with and bondable to the plug material and to concrete. The hardener for a two part resin system, in particular, requires to be selectively climatically compatible with the extremes of temperature experienced in a continental climate, and to have sufficient time before set-up to permit the preparation of a batch of plugs with the resin, and their insertion into the rod holes. At the same time it is economically imperative that the unset resin shall have an adequate pot life. Thus, it is desireable to specify a "summer" hardener or curing agent, and a "winter" hardener or curing agent.

It has been found that soaking the entire plug in the liquid resin achieves consistent sealing results, to the extent that under tests carried out with the subject plugs no occurrence of subsequent plug failure has yet taken place.

It will be noted that the selection of closed cell foam as the plug material permits a saving in the quantity of liquid resin absorbed by the plug, as compared with the open-cell plug, while achieving satisfactory sealing results.

In accordance with a preferred embodiment of the present invention, a system for plugging holes in concrete with water resistant plugs is provided which incorporates the use of diametrically oversized plugs selected from a natural fibre or synthetic foam, providing a liquid resin material which possesses sufficient setting time under existing ambient temperature conditions to utilize a plurality of plugs with a batch of the liquid resin adhesive, soaking the plurality of plugs by total immersion in the liquid resin material, and inserting the plugs individually within the holes to be sealed. Once inserted, the liquid resin will cure and harden, whereupon the plugs will each be adhesively or interstitially secured in place.

The invention is practised by use of a kit comprising a plurality of oversize plugs of predetermined diameter selected from a natural fibre group comprising jute and hemp, or a synthetic foam selected from the group comprising closed cell or open cell polyurethane, polyethylene and polystyrene; and a suitable liquid resin material, which may be a high solids polyisocyanate prepolymer which will harden to a polyurethane polymer in the presence of water, or a two part epoxy adhesive comprising a first component liquid selected from a group having an epoxide equivalent weight in the range 182 to 190, and a separately packaged hardener selected in accordance with seasonal setting requirements from the group comprising polyamines, aliphatic amines, aliphatic amine adducts, aromatic amines, cycloaliphatic amines, phenol formaldehyde adducts, amido amines, polyoxypropylene amines and polyamides.

In general, the present invention contemplates that sealing plugs be inserted only into the inner (inside)

ends of all rod holes that are left in a poured concrete foundation wall. There is little or no need to place the plugs of the present invention in the outer ends of the rod holes—which, however, may be closed in the usual manner by driving cork plugs into them so as to preclude gross water infiltration flow, or the entry of soil or other materials into the rod holes during back filling of the excavation at the exterior side of the foundation walls. It is sufficient to plug the inner ends of the rod holes in the manner provided by the present invention, to preclude water seepage of any sort through the rod holes from the exterior side of the wall to the interior.

Thus, the present invention provides for the combination of a concrete wall having a plurality of penetrating holes of predetermined size extending through the thickness thereof, and a plug inserted within each of the holes in secured adherent sealing relation with the walls of the holes, the plug comprising an initially oversized compliant material selected from the group of natural fibres comprising jute and hemp or and the group of synthetic foams comprising open cell or closed cell polyurethane polyethylene, or polystyrene; and being sealed in adherent relation to the wall of the hole by either a high solids polyisocyanate prepolymer which will harden to a polyurethane polymer in the presence of moisture (water), or a two part epoxy adhesive comprising an admixture of a first liquid component selected from the group of epoxy resins having an epoxide equivalent weight in the range of 182 to 190 and a compatible liquid hardener possessing suitable seasonal time setting requirements selected from the group comprising polyamines, aliphatic amines, aliphatic amine adducts, aromatic amines, cycloaliphatic amines, phenol formaldehyde adducts, amido amines, polyoxypropylene amines and polyamides.

In carrying out the invention, the subject plug is inserted within the rod hole, usually so as to be a slight distance below the surrounding wall surface, between one eighth inch and one-fourth inch being the recommended depth of recess. While not forming part of the present invention, it has been found that a surface rendering to cover the hole and plug provides a greatly enhanced appearance.

The surface rendering is preferably of a thick, non-sag epoxy topping compound that is compatible with the epoxy material which coats the plug.

The usual manner of carrying out the invention is to manually place the plugs in the interior (i.e., inside) ends of the rod holes that are left in the formed concrete walls after the shuttering has been removed. The plugs may be placed immediately after the shuttering is removed; however, it is more usual to wait until the concrete has at least a 48 hour to 7 day set, and it is most usual to place the plugs after the concrete basement floor has been poured and set—usually well on in the construction of the house or building. The plugs may, of course, be put in place by a mechanical means, such as a piston or air-operated gun that inserts the resin-soaked plugs into the rod hole.

BRIEF DESCRIPTION OF THE DRAWINGS

Certain embodiments of the present invention are described, reference being made to the accompanying drawings, wherein.

DETAILED DESCRIPTION OF THE PREFERRED EMBODIMENTS

Figure 1:
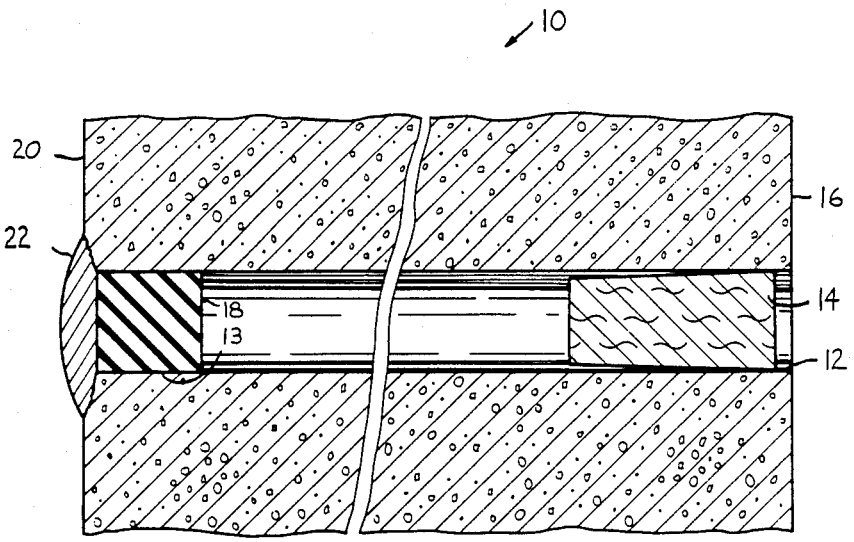
FIG. 1 is a transverse section through a portion of a concrete wall having a rod hole therethrough, showing the subject plug installed therein.
Figure 2:
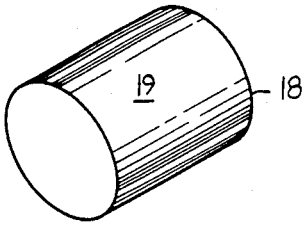
FIG. 2 is a general view of the plug.

Referring first to the drawings, portions of a wall 10 having a rod hole 12 extending therethrough are shown. The rod hole 12 is provided with an outer plug 14 adjacent the wall outer surface 16, and an inner plug 18 located in recessed relation from the wall inner surface 20. A surface patch 22 of epoxy topping compound is illustrated, although it does not form a part of the present invention.

As mentioned, the outer plug may be—and usually is—the standard cork plug that is used in such structures for closing the outer end of the rod hole.

The subject plug 18 is of suitable material as specified above, having a length of about one inch, and a diameter slightly greater than the diameter of the rod hole 12, so as to compress the resin soaked plug 18 when it is inserted under manual pressure (or otherwise, as discussed hereafter) into the rod hole 12. The elastic memory of the plug material tends to restore its diameter, holding the resin soaked peripheral surface 19 of the plug 18 in intimate bonding contact against the wall portion 13, which the plug 18 overlies. There may also be an interstitial bonding, by which the hardened resin physically intrudes into interstices or other irregularities in the bore of the rod hole, and thereby creates a mechanical linking as well as an adhesive bonding.

It has been found that a permanent bond is formed by the subject system between plug 18 and surface 13 of hole 12.

It should also be noted that the system, and method, of the present invention may be automated; it being only necessary that the plug be at least somewhat diametrically compressed prior to being placed in the rod hole, and that the placement be carried out before the resin sets up and hardens.

The usually employed two part epoxy adhesive comprises a number of variants, which may conveniently be selected from compatible resins, diluents and hardeners listed below, together with their commercial sources.

It will be understood that the season of year in which the plugs are to be installed will affect the choice of a rapid cure hardener agent, or a slower curing hardener agent.

Suitable liquid resins which are the two part epoxy materials used in this invention, are produced by reacting epoxy resins with amine hardeners.

Typically the epoxy resin liquid has an epoxide equivalent weight in the range 182 to 190 such as DER 331 supplied by Dow Chemical Company, Midland, Mich. 48640, U.S.A. Variations of this resin such as DER 317, 330, 332 or 337 may also be used.

The resins described above may also be diluted with reactive diluents such as the following:

Butyl Glycidyl Ether
Cresyl Glycidyl Ether
Phenyl Glycidyl Ether
p-tert.-Butyl Phenyl Glycidyl Ether
2-Ethylhexyl Glycidyl Ether
$C_8$–$C_{10}$ Alkyl Glycidyl Ether
$C_{12}$–$C_{14}$ Alkyl Glycidyl Ether
Di Functional Glycidyl Ethers
Diglycidyl Ether of 1.4 Butanediol
Diglycidyl Ether of Neopentyl Glycol.
Diglycidyl Ether of Cyclohexane-Dimethanol
Diglycidyl Ether of Resorcinol
Tri Functional Glycidyl Ether Triglycidyl Ether of Aliphatic Polyols such as WC-84 as supplied by Wilmington Chemical Corporation, Pyles Lane, Wilmington, Del. 19899, U.S.A.

Epoxy modified with urethanes such as WC-8598, Wilmington Chemical, P.O. Box 66, Pyles Lane, Wilmington, Del. 19899, U.S.A.

Epoxy modified with synthetic buatadiene acrylonitrile such as WC-8005, WC-8006 and WC 8028, Wilmington Chemical.

Other additive material such as phenols, nonyl phenol, oils, etc. may also be added to modify the epoxy resin. The epoxy resins described above are all based on bisphenol-A as a principal reactant. They may also be based on bisphenol-F as a principal reactant, e.g., DER 351 and 352 (Dow Chemicals). Other modified epoxy resins such as the Polysulphides may also be used as the epoxy resin for the purpose of this invention, e.g., Dion 3.800 as supplied by Diamond Shamrock, 350 Mt. Kimble, Moristown, N.J. 07960, U.S.A.

Many hardeners of the amine type may be used as crosslinking agents for the epoxy resins described above. These fall into, but are not limited to, the following categories:

Those promoting a preferred rapid cure, such as:

Polyamines: Such as Aliphatic Amines, Aromatic amines or Cylcloaliphatic Amines;

Aliphatic Amines e.g.,

Diethylenetriamine (DETA)

Triethylenetetramine (TETA);

Aliphatic Amine Adducts: Formed by reacting excess quantities of aliphatic amines with epoxy containing materials;

Aromatic Amines, e.g. Anacamine LO and Ancamine LOS from Pacific Anchor Chemical Corp. 6055 East Washington Blvd., Suite 700, Los Angeles, Calif. 90040 U.S.A., e.g., Hardener 850 and Hardener 830 from Ciba-Geigy Corporation, Ardsley, N.Y. 10502, U.S.A.;

Cycloaliphatic Amines e.g. Ancamine MCA and Ancamine 1561 from Pacific Anchor; or Phenol Formaldehyde Adducts e.g., Versamine F-20 from Henkel Corporation, 7900 West 78th Street, Minneapolis, Minn. 55435, U.S.A.

Those that modify the curing time, as slower curing hardeners, such as:

Amido Amines, Polyoxypropylene amines and Polyamides.

Amido Amines e.g., Ancamide 500 and Ancamide 501 from Pacific Anchor;

Polyoxypropyleneamines, e.g., Jeffamine D230 and Jeffamine D200 from Jefferson Chemical Company Inc. subsidiary of Texaco Inc.; or Polyamides e.g., Versamid 140,150 from Henkel Corporation.

Alternatively, the liquid resin may be a single component resin that is a high solids (i.e., non-solvent) polyisocyanate prepolymer that is suitably modified with surfactants and catalysts so as to cure (i.e., react) in the presence of moisture (water) to a hardened polyurethane polymer. Such liquid resins require the presence of water to cure in a reasonable time (say thirty minutes to four hours); and may indeed require that the rod holes be wetted down if they are being used in a hot and dry environment.

Suitable polyisocyanate prepolymers include:

CAPPAR CS 149 (from Cappar Limited of Brampton, Ontario, Canada), which is a modified high solid composition that may be used in such circumstances where the concrete surrounding the rod hole is still quite young but may be dry to the touch; or DECI 16 (from N.V. Denys of Gent, Belgium), which is a polyfunctional polyol with isocyanate groups, and which will react with in-situ water to form an insoluble polyurethane polymer.

The scope of the present invention is defined by the accompanying claims.

What is claimed is:

1. A method of providing a climatically compatible, low cost rod hole sealing system for sealing rod holes in poured concrete foundations, comprising the steps of:

(a) preparing a plurality of compressible oversize plugs, each of which is nominally larger in diameter than the rod hole into which it will be placed;

(b) selecting a liquid resin material which will set and harden in less than a few hours time under ambient temperature conditions;

said liquid resin material being a high solids polyisocyanate prepolymer which will harden to a polurethane polymer in the presence of water, the prepolymer being modified with surfactants and catalysts so as to cure in the presence of water in less than a few hours time to a hardened polurethane polymer;

(c) immersing said plurality of plugs in submerged soaking relation with said liquid resin material;

(d) retrieving said plugs after they are soaked with said liquid resin material;

(e) inserting said liquid resin soaked plugs under deforming pressure individually into individual ones of said rod holes; and (f) retaining each said liquid resin soaked plug immoveable in said rod hole until cure of said liquid resin material is sufficiently complete to provide adhesion between said plug and the wall of said rod hole.

2. A method of providing a climatically compatible, low cost rod hole sealing system for sealing rod holes in poured concrete foundations, comprising the steps of:

(a) preparing a plurality of compresible oversize plugs, each of which is nominally larger in diameter than the rod hole into which it will be placed;

(b) selecting a liquid resin material which will set and harden in less than a few hours time under ambient temperature conditions; the liquid resin being selected from the group consisting of;

a two part epoxy adhesive selected from adhesives having a first component liquid epoxy resin have an epoxide equivalent weight in the range of 182 to 190, and a second hardener component selected from the group consisting, in accordance with seasonal ambient temperature conditions; of hardeners to provide setting of said epoxy adhesive in less than a few hours time;

(c) immersing said plurality of plugs in submerged soaking relation with said liquid resin material;

(d) retrieving said plugs after they are soaked with said liquid resin material;

(e) inserting said liquid resin soaked plugs under deforming pressure individually into individual ones of said rod holes; and (f) retaining each said liquid resin soaked plug immoveable in said rod hole until cure of said liquid resin material is sufficiently complete to provide adhesion between said plug and the wall of said rod hole.

3. The method of claim 2, wherein the second hardener component is chosen from the group consisting of polyamines including aliphatic amines, aromatic amines, amido amines, polyoxyproplene amines, and cycloaliphatic amines; aliphatic amine adducts; phenal formaldehyde adducts; and polyamides.

4. A method of providing a climatically compatible, low cost rod hole sealing system for sealing rod holes in poured concrete foundations, comprising the steps of:

(a) preparing a plurality of compressible oversize plugs, each of which is nominally larger in diameter than the rod hole into which it will be placed, and which is formed of closed cell synthetic foam;

(b) selecting a liquid resin material which will set and harden in less than a few hours time under ambient temperature conditions, said liquid resin material being a two part epoxy adhesive having a first component liquid epoxy resin having an epoxide equivalent weight in the range of 182 to 190, and a second hardener component which is a polyamine.

* * * * *